United States Patent [19]

Clem et al.

[11] 4,035,986

[45] July 19, 1977

[54] UNIVERSAL HEAD AND INTERMEDIATE GRID FOR CASE PACKERS

[75] Inventors: William E. Clem; John F. Nolan, both of Lancaster, Ohio

[73] Assignee: Anchor Hocking Corporation, Lancaster, Ohio

[21] Appl. No.: 645,622

[22] Filed: Dec. 31, 1975

[51] Int. Cl.[2] ..... B65B 57/10; B65B 5/08

[52] U.S. Cl. ..... 53/61; 53/161; 53/247; 53/248

[58] Field of Search ..... 53/61, 161, 247, 248

[56] References Cited

U.S. PATENT DOCUMENTS

| | | | |
|---|---|---|---|
| 3,031,820 | 5/1962 | Schulze et al. | 53/247 |
| 3,694,993 | 10/1972 | East | 53/248 X |
| 3,702,524 | 11/1972 | Johnson et al. | 53/248 X |
| 3,834,117 | 9/1974 | Gift | 53/61 |

*Primary Examiner*—Travis S. McGehee
*Attorney, Agent, or Firm*—Wood, Herron & Evans

[57] ABSTRACT

A universal head for a drop type case packer, for enabling the packer to handle a range of article sizes and arrays. Lane dividers mounted from the head define parallel lanes, the number, spacing and effective length of which can be set for desired packing conditions. Flags for signaling filling of the lanes are mounted to an adjustable end plate, and can be centered laterally according to lane width and article shape. The flags intercept a light beam between a light emitter and sensor, the alignment of which is maintained regardless of changes in lane number or dimensions.

A universal intermediate grid is also provided, having article guide flaps which can be positioned longitudinally to accommodate various arrays and sizes. The flaps are mounted diagonally with respect to transversely positionable bars, and cross bars are obviated.

10 Claims, 7 Drawing Figures

UNIVERSAL HEAD AND INTERMEDIATE GRID FOR CASE PACKERS

This invention relates to improvements in case packers, that is, machines for placing articles, usually containers, in cases or cartons, in predetermined array. More specifically, the invention relates to those portions of case packers which are known as the head and the intermediate grid, and provides a universal capability whereby a case packer is enabled to handle articles over a wide range of sizes and packing arrays.

BACKGROUND OF THE INVENTION

The operation of a typical case packer may be taken as a starting point for an explanation of the invention. Articles such as glass containers are continuously supplied to the packer by a conveyor. The moving articles are formed into a predetermined number of parallel lines, typically although not necessarily two, three or four lines. The incoming articles are essentially in single file relation in each line. The conveyor feeds the articles into an array-forming section of the packer which is commonly referred to as the "head." There the articles are grouped or segregated into a desired pattern for packing. This array, i.e., the number of lines and the number of articles in each line, corresponds to the particular case into which the articles are to be packed. The most commonly used arrays include 3×4 (12 pack), 3×5, 3×6, and 4×6, although others are sometimes used. The lines are separated in lanes, spaced apart by lane dividers. The articles are fed into the respective lanes by line pressure, that is, the push which arises from the movement of the articles in the conveyor.

In the lanes the articles rest on a so-called "shiftable grid," which comprises a series of underlying parallel bars which extend longitudinally along the center planes of the respective lanes. A sensing means such as a photocell, senses when all of the lanes have been filled by the incoming articles. It then triggers a grid shift cylinder which shifts the grid transversely, so that the grid bars are moved out from beneath the articles, and the unsupported but still arrayed articles drop from the head, under the influence of gravity.

Where the articles are to be packed in upright position in the case, they drop directly from the head into the case, which is positioned below to receive them. As they drop, the articles are guided toward and into the respective cells, between the partitions of the case, by a so-called "intermediate grid." This grid presents a series of flexible fingers or flaps around the fall path of each bottle, which "funnel" the article into its particular cell. Case packers having such features are shown in the U.S. Pat. Nos. to Raudat 3,561,189; 3,353,331; and 3,479,791, to which reference may be had for further background details.

It is sometimes necessary to pack containers in inverted condition, i.e., neck down in the case. For such invert packing, the packer will include a container-inverting mechanism below the upper head. The inverting mechanism turns the container upside down after they have been arrayed, and before they are released into the cells of the case. According to one technique for accomplishing such inversion, as shown in U.S. Pat. Nos. 3,694,993 to East, and 3,852,938 to Graff, the arrayed containers are dropped upright from the nead onto vacuum cups which engage and grip them at the bottom. The vacuum gripping section, holding the containers, is then inverted 180°. Once inverted, the vacuum is released and the containers drop into the case. Again, they may be guided or funneled as they fall by an intermediate grid. In another type of invert packer, shown in Birrell U.S. Pat. No. 3,443,355, the bottles are gripped at their sides by jaws (rather than by vacuum cups at the bottom), then inverted and dropped into the case.

Any automatic case packer must be matched to the size of the particular articles which it is to pack and to the array which the case accepts. Different arrays as well as different articles sizes may require not only different numbers of lanes, but also different lane widths and lane lengths. The dimensioning must also be reflected in the shifting grid, the inverting mechanism (if used), and the intermediate grid below it.

In the glass container industry, manufacturers typically produce containers in a wide range of sizes. They are packed by the manufacturer in corrugated cases of different sizes and arrays, for shipment to food and beverage processors for filling. There has not heretofore been available suitable structure for accommodating, in a single packer, the many different sizes and arrays of articles which that machine may be used to pack. As an example, a typical glass container manufacturer may produce and pack more than 30 different types of containers having sizes which may range from 1¾inches in diameter up to more than five inches. In order to enable a given machine to handle articles of different sizes, it has been the common practice to use a series of several heads, shifting grids and intermediate grids, each individually sized to handle a different particular size and array of ware to be packed. These parts, which are known collectively as change parts because they permit change of size, are adapted to be interchangeably mounted in a given packer, according to the articles to be packed. It will be apparent that a capability for packing a wide range of articles requires a correspondingly large inventory of change parts for adapting the packer to the particular articles.

It has been the objective of this invention to provide universal structures for the head and intermediate grid, which will enable a case packer to handle various arrays and a wide range of article sizes, without the multiplicity of change parts heretofore necessary.

BRIEF DESCRIPTION OF THE INVENTION

The head and intermediate grid in accordance with the invention are preferably used together, but they may be used independently of one another. In preferred form, the head includes a frame and means for mounting it in a packer. A series of lane dividers are mounted from the frame and provide a plurality of parallel lanes between them for receiving articles in single file relation. An end plate is mounted from the frame and extends transversely across the lane dividers, and presents a barrier which limits the length of each lane. The end plate carries a plurality of movable flags that project into the respective lanes, each flag being positioned for engagement by an article in its lane when the article is proximate to the end plate. At least some of the flags are mounted from the end plate by means for shifting them in a direction transverse to their lanes, in order to be aligned with the respective central planes of a particular size of article to be received in the lanes. Preferably, the end plate extends transversely across the lanes above base walls of the respective lane dividers, and the end plate has lane stops mounted to it which project downwardly into the respective lanes between the base walls of the lane dividers. The lane stops are shiftable laterally with respect to the end plate, and they can be secured to the end plate in different positions to correspond with different lane spacings. The flags are swingably mounted to the stops, and they are shifted laterally to the lanes as the corresponding stops are shifted.

In preferred form the head includes a sensor for sensing when articles in all the lanes are at the end plate, the sensor comprising a light source mounted to the end plate for movement with it and positioned to direct a beam of light parallel to the end plate and transversely across the lanes. The flags associated with each lane are movably mounted behind the end plate and are movable by the corresponding articles from beam blocking position, when no article is at the end plate, to a non-beam blocking position when an article is at the end plate in that lane. The flags are biased toward the beam blocking position. A light receptor is mounted to the end plate for movement with it, and is aligned to receive the beam from the source when the beam is not blocked by any of the flags. The end plate, flags, source and receptor are all simultaneously shiftable as a unit, longitudinally of the respective lanes, by movement of the end plate with respect to the frame.

The intermediate grid in accordance with the invention comprises a frame having side and end members with a plurality of parallel bars connected between the end members. The connecting means are adjustably positionable for shifting the bars laterally on the end members. There are no cross bars.

Each bar carries a plurality of holders, each mounting one or more guide flaps, the holders being slidable along the bars for longitudinally positioning the guide flaps. The holders preferably include posts slidably engaging the bar, projecting vertically to it. A body is mounted to the post, and the guide flaps are positioned on the body so that they project from the body in a direction diagonally to the bar, rather than perpendicularly or parallel to it. The flap or flaps are clamped to the body, and the post is clamped to the bar through a surface on the body which bears frictionally on the bar when the body is secured to the post.

THE PRIOR ART

Cella U.S. Pat. No. 3,250,371 shows a case loader in which lane width adjustment is provided by suspending the lane dividers from overhead bars along which they can be slid to desired transverse position. A stop fence is adjustably positionable in the longitudinal direction.

Raudat U.S. Pat. No. 3,561,189 shows a packer which includes means for adjusting both the width and the length of the lanes. Lane dividers are supported on threaded bars on which they can be locked in position, for a given lane width, by lock nuts. A lane end stop is mounted on slides and is movable in the direction parallel to the lanes, for lane length adjustment. The intermediate grid is adjustable in length simultaneously with the lanes, by movement of the lane end stop. East U.S. Pat. No. 3,694,993 shows sensors for determining when the lanes have been filled with articles, in the form of vertically extending, swingable flags which pass through a fixed end stop and into the respective lanes. As an article moving into the lane approaches the end stop, it engages and swings the flag about a pivot, from a lane open position in which the flag blocks a beam of light from falling on a light receptor, to a lane full position in which the flag no longer blocks the light beam from falling on the sensor. When all of the lanes are full, all of the flags have been moved to their lane full positions and the beam of light passes unblocked to the receptor, and automatic operation is initiated. The flags are carried on a separate, rectractable platform which is shifted up to the fixed end stop when the lanes are filling, and shifted away to provide clearance when the containers are to be dropped. In one commercially available packer, the flags are carried on the head so that they move vertically with it.

With respect to the intermediate grid, it is known to provide an egg crate type construction of intersecting mutually perpendicular bars, with article guiding flaps mounted along the respective right angular bars as in Kimball U.S. Pat. Nos. 2,219,827 or 3,505,787, or at their intersections. Raudat, supra, mounts flaps on longitudinal bars only, but only parallel to the bars on which they are mounted. The flaps wear over a period of time in use, and it is known to provide for replacement of the flaps. However, there has not heretofore been any intermediate grid which utilized adjustable longitudinally extending bars, without intersecting transverse extending bars, and wherein the flaps were adjustably positionable along the longitudinal bars.

The invention can best be further described and its advantages explained by reference to the accompanying drawings, in which.

For purposes of explanation, the drawings show the invention in the environment of an invert case packer, which may for example be of the general type shown in U.S. Pat. No. 3,694,933, previously discussed. However, it should be understood that a head and/or intermediate grid in accordance with the invention can be used in other drop packers, including packers which do not invert the ware. Further for purposes of explanation only, the apparatus is shown as set for packing narrow neck glass bottles, arranged in a 2—3 array (6 pack).

GENERAL ORGANIZATION

Figure 1:
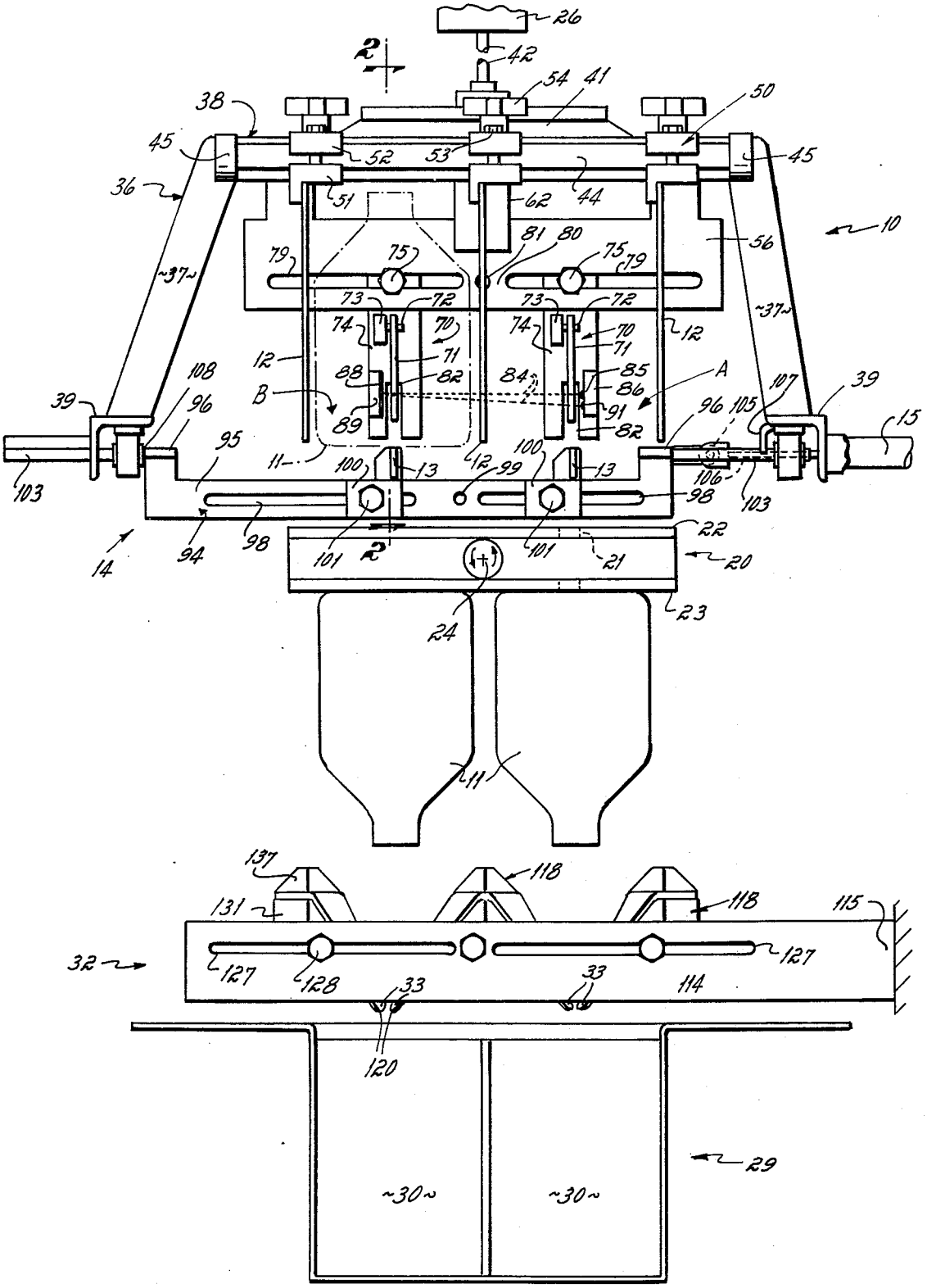
FIG. 1 is a transverse vertical section, somewhat diagrammatic in nature, of a portion of an invert case packer having a head and intermediate grid in accordance with a preferred form of this invention.

The case packer shown in FIG. 1 includes head and intermediate grid in accordance with the invention. The head, in which the bottles or other articles 11 to be packed are segregated in the desired array, is designated generally by 10. The articles 11 are infed to head 10 by conveyor apparatus which may be conventional, indicated at 17 in FIG. 2. The parallel rows or lanes (designated at A and B in FIG. 3) of articles are separated and guided into the head by lane dividers 12. Within each lane the articles 11 are supported from below, prior to drop, by the respective support bars 13 of a shiftable grid designated generally at 14. When the lanes are full, the shiftable grid is shifted (to the right in FIG. 1) by a grid shift cylinder generally at 15, so that the bottles are no longer supported from below and are free to drop. A gating mechanism closes the lanes when they have received their full complements of articles, thereby segregating the array and preventing other articles from entering the lane area during drop. The gating mechanism may be conventional and is not shown.

For invert packing, the articles 11, when released by shifting of grid 14, are dropped onto a vacuum platen, designated generally at 20. The vacuum platen itself may be of known design, and has vacuum heads or cups indicated by the dotted lines 21 in FIG. 1, or extending from its face 22. Vacuum connnections to the respective cups 21 are supplied through lines not shown. Each article is held on the platen by the vacuum, which acts on the article at its base. The platen is rotatable 180° about a horizontal pivot 24 to invert the articles while they are held by vacuum.

Head 10 and grid 14 attached to it are vertically elevatable by conventional means such as the cylinder shown at 26. As is known, such elevation provides clearance so that the articles, when held on the vacuum platen, can be inverted and will not be dislodged by the grid or head. The vacuum platen 20 may have vacuum cups 21 on both of its opposite faces 22 and 23, so that articles can be dropped onto one face while the other face is inverted over a case for dropping articles held on that face. A corrugated case, designated generally at 29, is positioned by conventional conveyor means, not shown, beneath and in vertical alignment with the head 14 and platen 20, such that when the vacuum is released, bottles on the downward platen face 23 will drop into the respective cell 30 of the case. The intermediate grid 32 is disposed between case 29 and platen 20, and eases the drop of the articles and guides them into the respective cells of the case. The intermediate grid mounts a series of guides or fingers generally at 33, which project into the respective cells 30 of the case.

With this overall description as background on the environment in which the invention is used, the individual components are next described in detail.

THE HEAD

Figure 2:
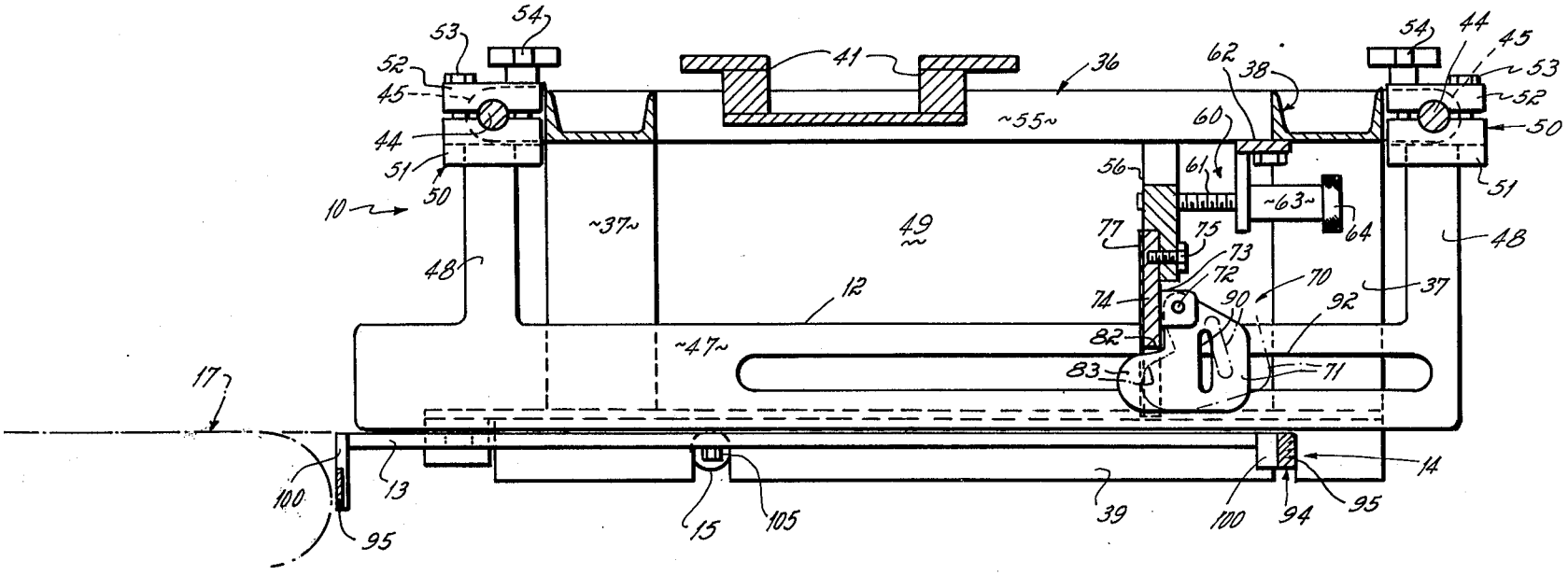
FIG. 2 is an enlarged longitudinal section of the head and shiftable grid.
Figure 3:
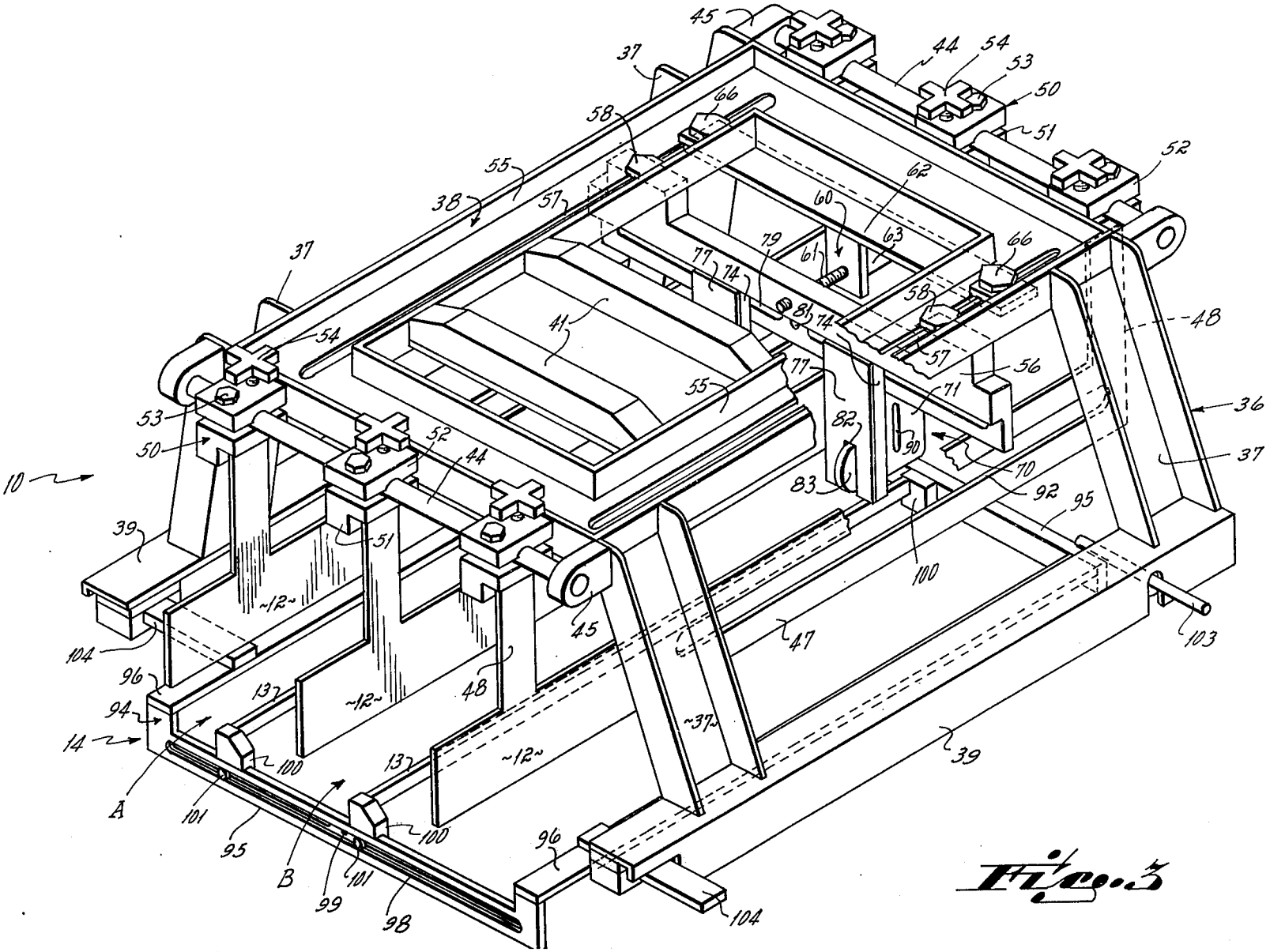
FIG. 3 is an isometric view of the head and shiftable grid.

The head 10 is shown in FIGS. 1, 2 and 3. It includes a frame 36 which, viewed endwise as in FIG. 1, is generally in the form of an inverted U. Legs 37 on opposite sides of the frames are connected at their upper ends by a top brace 38 which, as seen in plan (FIG. 3), is generally rectangular in form, the legs 37 joining it at its corners. At their lower ends, the legs 37 on each side are connected by a longitudinal beam or angle 39.

The top brace 38 supports cross mounting brackets 41 by which head 10 is attachable to the lower end of a vertical piston rod 42 operated by cylinder 26 (see FIG. 1). As previously explained, the cylinder is used to raise or lower the entire head with respect to the invertable vacuum platen 20.

Across each of the two opposite ends of top brace 38, a hanger rod 44 is mounted by brackets 45, so that the rods extend above and transversely to the lanes. A series of planar vertical lane dividers (three in the embodiment shown for purposes of explanation), each designated by 12, hang from the two rods 44. The three lane dividers shown define two lanes A and B between them, each lane having a width such that it can receive the incoming articles from conveyor 17 and guide them as they move into the lanes under line pressure, so that infed articles do not tip over. As they move into the lanes, the articles are supported from below on the support bars 13 of the shiftable grid.

As best shown in FIG. 2, each lane divider 12 has an elongated base wall 47 from which two upstanding legs 48 project vertically upward. The base wall 47 has sufficient height that it guides or supports the incoming articles, but it terminates well below top brace 38, so that an opening 49 is presented between the legs 48, 48 above base wall 47. At its upper end, each leg 48 is provided with a split clamp 50 by which the leg is clamped to one hanger rod 44. More particularly, each split bracket 50 includes lower and upper halves 51, 52, the lower half 51 being secured to the lane divider leg 48 and the upper half 52 being attached to the lower half 51 by a keeper or bolt 53. Bar 44 is received in semicircular recesses formed in the respective halves 51, 52. A hand-operated screw 54 is used to draw the two halves 51, 52 together so as to clamp the leg to the bar.

The lane dividers 12 are of sufficient length to accommodate the longest array with which the head 10 is designed for use; similarly, the rods 44 are sized to accommodate the widest array. The width of the individual lanes A, B, etc., can be set for a given size of articles 11, by loosening the hand screws 54 of the respective lane dividers, and sliding the dividers inward or outward along the rods 44, 44. Other lanes in addition to the two shown can be added merely by hanging additional lane dividers from the rods, and adjusting spacing as appropriate.

The effective length of the lanes is determined by the longitudinal position, with respect to frame 10, of an end plate 56. The end plate extends transversely above the base wall 47 of the lane dividers, through the open area 49. The end plate 56 is suspended from top brace 38 and is longitudinally adjustable along it, in order to set the effective length of the lanes. For this purpose, a longitudinally running slot 57 is provided in each top brace side member 55. Locking screws 58 extend through the slots 57 and are threaded into ears upstanding from the end plate to hold the plate.

Approximate positioning of the longitudinal position of the end plate along the top brace can be made by manually sliding it to desired position. For more accurate positioning, a screw adjusting means is provided indicated generally at 60 (see FIG. 2). Specifically, a screw 61 is secured to and projects longitudinally from end plate 56. The screw passes through an aperture in a flange depending from a cross bracket 62, and a rotatable member 63 with a knurled hand-grip 64 for turning it, is threaded onto the screw. Bracket 62 is fastened to the top brace by screws 66 which pass through the slots 57. For precise positioning of the end plate, the bolts 66 are tightened so that the bracket and rotatable member 63 are fixed in longitudinal position. The end plate screws 58 are loosened, and by turning member 63 on screw 61, the end plate is moved fore or aft so that the line of incoming articles can be stopped at precise position with respect to a carton below that is to receive them.

The shiftable grid must not, of course, be shifted from bottle supporting position until all of the lanes have been filled and the lane gates (not shown, but which are well known in the art) are closed, so that the articles are segregated from the line. In order to detect filling of each of the lanes, signal means are provided in the form of article-operated flags which intercept a light beam. A separate flag is provided for each lane, one of them being shown in FIG. 3 generally at 70. Since the number of lanes can be changed, as well as the width of the lanes, it is important to provide for the addition of flags for more lanes; moreover, each flag must be positionable accurately in the center of its particular lane. Only if the flag is positioned on the lane axis will it be operated by the foremost surface of a cylindrical incoming article 11. It can be appreciated that if a flag were off-center, it might not be contacted by the bottle at all, because of the curvature of the bottle surface.

Each flag 71 is preferably planar and vertically oriented, being pivoted at 72, at a forward upper corner (see FIG. 2). The pivot axle projects from an ear 73 carried by a lane stop 74. In each lane, a lane stop is removably secured by a bolt 75 to the end plate 56, and projects downwardly from the end plate into the respective lane. Each lane stop 74 is faced with a pad 77 of rubber or similar cushioning material on its forward face, which arrests the forwardly moving articles.

The lane stops 74 are laterally adjustable with respect to the end plate from which they are suspended. Specifically, the bolts 75 pass through slots 79 (see FIG. 1) to permit lateral shifting of the stops. The slots 79 may run continuously across the end plate, or they may be interrupted, as at 80, by a connecting web. In the latter case, a central opening at 81 should be provided in the web so that one lane stop can be positioned on the center axis of the device if an array having an odd number of lanes is to be packed.

Each lane stop 74 has a central vertical slot 82. A lobe 83 on the flag normally projects through slot 82 into the lane, where it will be abutted by an article as the article approaches the lane stop. As shown in FIG. 2, the shape of the flag is such that the flag is biased by gravity (alternatively by springs, etc.) toward a normal or lane open position with the lobe projecting through slot 82 into the lane. When a bottle or other article in the lane contacts the flag lobe, it moves the flag forwardly until the article abuts the cushion 77, swinging the flag (counterclockwise in FIG. 2) to the dotted line or lane full position.

In the lane open position, the flag interrupts a beam of light that is directed transversely across the lanes, preventing the beam from reaching a detector. In the lane full position, the position of the flag is such that an aperture 90 (see FIG. 2) in the flag is aligned in a non-beam blocking position.

More specifically, a light source 85, which may be in the form of a light emitting diode, is mounted for movement with the end plate, and preferably on an outer lane stop. It projects a beam across the lanes, but the beam is received by a detector only if all flags are in the lane full position. It is especially advantageous to mount both the light source and the detector adjacent to one another on the same side of the head, with the beam reflected by a mirror on the opposite side of the lanes back to the detector.

In the preferred embodiment, the light emitter is a light emitting diode 85 mounted to a bracket 86 on lane stop 74 in the outer (right) lane. The light beam is directed, as shown by the dotted line 84, to a mirrorlike reflector 88 mounted to a bracket 89 on the leftmost lane stop, from which the beam is returned to a detector 91 in bracket 86, adjacent the source. Since the flags are preferably mounted low, between the base walls of the lane dividers, an elongated window or opening 92 is formed in the dividers, so that the beam will not be blocked by any interior wall, regardless of the longitudinal position of the end plate. In the lane open position of the flags, the flags block beam 84, and the beam does not reach mirror 88 and is not reflected. When all the flags are in the lane full positions, the emitted and the reflected beams pass through the flag apertures 90, and the receptor is energized. The detector and emitter themselves may be conventional and do not comprise the invention. They may be combined as a single unit, such as is commercially available under the name Microswitch. Use of the mirror reflector is advantageous because it requires less careful alignment than would an opposed source and detector, but alternatively the reflector may be mounted across the lanes for direct (unreflected) reception of the beam.

From the foregoing it can be seen that the light source, the detector, and the reflecting means are all mounted to the end stop so that when the end stop is shifted longitudinally, full alignment is maintained between them. This has proven far easier to operate and maintain than systems wherein the source and/or receptor were located on the frame or other separate structure, rather than the head. Moreover, since the source, detector and reflector are mounted directly on the lane stops, sidewise shifting of the lane stops does not affect the alignment thereof. The signal detected by the sensor 91 may be applied to conventional circuitry for initiating the automatic operation.

THE SHIFTING GRID

From FIG. 1 it can be seen that the longitudinally-extending, article supporting bars 13 of the shifting grid lie generally in the mid-planes of their respective lanes (i.e., essentially below the flags 71 therein), to provide central support for the articles in the lanes. The bars 13 are carried on a shifting grid frame 94, best shown in FIG. 3. The frame comprises transverse members 95 joined by longitudinally extending side members 96. The entire frame 94 including the bars 13 mounted to it, is shiftable sidewise or transversely with respect to the frame 36 of head 10, so that the bars can be shifted from the article supporting position shown in FIGS. 1 and 3 to an article drop position (not shown) in which the bars essentially lie directly under the lane dividers 12, where they provide no support for the articles.

The support bars 13 are adjustably positionable along the transverse frame member 95, so that they can be spaced and positioned to suit different array configurations, and so that they will underlie the lane dividers when the grid is shifted to the drop position. For such adjustability, the frame members 95 are slotted as at 98, with a central opening 99 for positioning a bar 13 centrally, as required for a 3 or 5 lane configuration. The support bars 13 at their ends are mounted to brackets 100 which are slidable along the respective members 95, and which can be locked in place with respect to the frame by bolts 101.

The shiftable grid frame 94 is supported and guided for sliding shifting movement with respect to the head frame 36, by guide members 103 and 104 which slide in associated bearings mounted to the frame. The grid is shifted by the cylinder 15, the piston rod of which is connected through a toggle or link 105 (see FIG. 1) to the rod 106 of piston 15.

Each of the two positions to which the shifting grid is shifted by cylinder 15 must be matched with the configuration of the particular array to be packed. Referring to FIG. 1, the leftward shifted position of the grid should preferably be such that bars 13 are aligned with the centers of the respective lanes, as shown in the figure; and in its drop (or rightward shifted) position, the bars of the shiftable grid frame must lie beneath the respective lane dividers, to provide clearance for the articles to drop through. To fix these positions for any particular array, adjustable stops are provided as at 107 and 108 (see FIG. 1), to limit the extent of shift in each direction. The stops preferably comprise thin shims which are securable to the frame members.

The length or longitudinal dimension of the shiftable grid is sufficient to accommodate the maximum length of array to be handled. The length need not be shortened for any particular case configuration, because the lane stops effectively determine the length, and the articles merely fall between the bars 13 of the shiftable grid.

THE INTERMEDIATE GRID

Below the shifting grid, the articles drop onto the vacuum platen 20 for invert packing, and, after inversion, through the intermediate grid 32 into the case. Alternatively, for non-invert or upright packing, the articles are dropped directly into the cells 30 of the case 29, through the intermediate grid.

The grid is shown in FIGS. 1 and 4–7. It includes a generally rectangular frame defined by peripheral longitudinal or side members 111 and 112, and transverse or end members 113 and 114. A bracket 115 across one side may be provided for mounting the intermediate grid to a track or other means by which it may be moved vertically according to the size of the case to be packed, bottle dimensions, and so on. These means may be conventional and are not shown.

The article guide flaps 33 are mounted by flap holders 118 on laterally adjustable, longitudinally extending bars 119 that are connected at their ends to and between the transverse frame members 113 and 114. The spacing between adjacent bars 119 will correspond to the width of the cells 30 of the case in which the particular articles are to be packed. Substantially the same spacing will, of course, obtain between the supporting bars 13 of shifting grid 14, and also between adjacent lane dividers 12. Spacing must be adjusted to suit the number of lanes, size of the articles, case configuration, and so on, and at the same time the flaps 33 must be positioned along the bars so that their tips 120 will fall essentially symmetrically around the vertical central axis of the respective case cells.

The intermediate grid of this invention obviates the conventional egg crate grid construction (intersecting cross bars) of the past. Instead, all of the flaps are mounted on longitudinal bars, and they extend across the corners of the cells, i.e., at 45° angles from the bars 119 rather than perpendicular to them. No cross bars are used, the fingers 33 being carried solely by the bars 119 to which they are attached by the flap holders 118.

Figure 5:
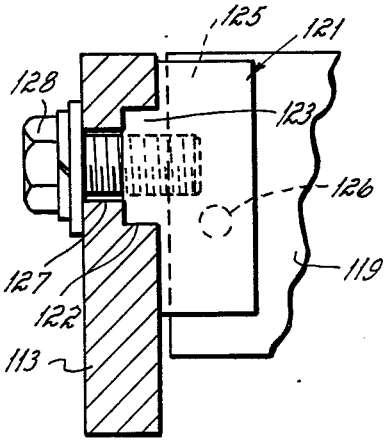
FIG. 5 is an enlarged fragmentary cross-section taken on lines 5—5 of FIG. 4.

The bars 119 are shiftably connected between the transverse members 113 and 114 by slidable connectors 121, shown in FIG. 5. The members 113 and 114 present grooves as at 122, and a boss or rib 123 on each connector 121 seats in and is slidable along the groove 122. The end of bar 119 is received in a vertical slot 125 in connector 121, and is secured in the slot as by a set screw 126. The transverse members 113 and 114 are slotted as at 127 (see FIG. 5) through the base of grooves 122, and a bolt 128 passes through the slot 127 into the connector. Thus the bars 119 can be slid to any desired spacing, while the rib-in-slot interfit maintains the bars 119 in verticality at any position.

Figure 6:
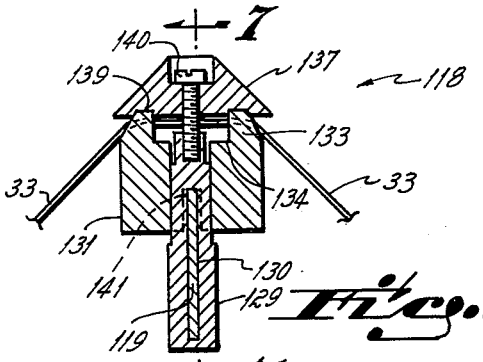
FIG. 6 is an enlarged fragmentary vertical section taken on lines 6—6 of FIG. 4, showing the means for securing the flaps to the bars of the intermediate grid.
Figure 7:
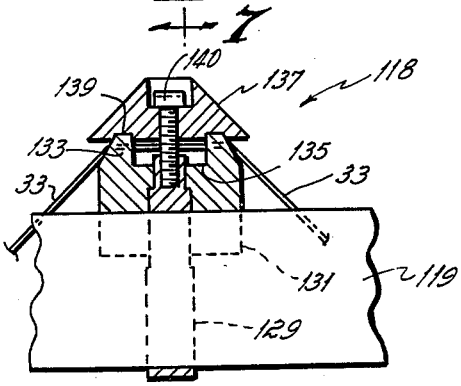
FIG. 7 is a section taken on line 7—7 of FIG. 6.

FIGS. 6 and 7 show details of the flap holder 118 by which the flaps 33 are adjustably positioned along the bars 119. The bar 119 passes through a diametral slot 130 in a cylindrical post 129, and the post projects upwardly into a vertical central aperture in the holder body 131. At its top, body 131 has four upstanding lugs 133, spaced at its corners, with horizontal cross grooves 134 and 135 extending at right angles to one another and at 40° angles to bar 119. The flaps of fingers 33 are shaped so that they can be seated in the slots 134 and 135 and oriented therein by the lugs which engage them at their sides. The flaps are held within the grooves by a cap piece 137 which is generally pyramidal in shape and which has recessed sockets 139 at its corners, into which the lugs 133 project. This interfitting relation prevents the cap piece 137 from turning with respect to the body 131. The cap is held down by a bolt 140 which passes through central openings in the cap and in the one or two flaps that are seated in the grooves 134 and 135, and is threaded into the post 129.

Figure 4:
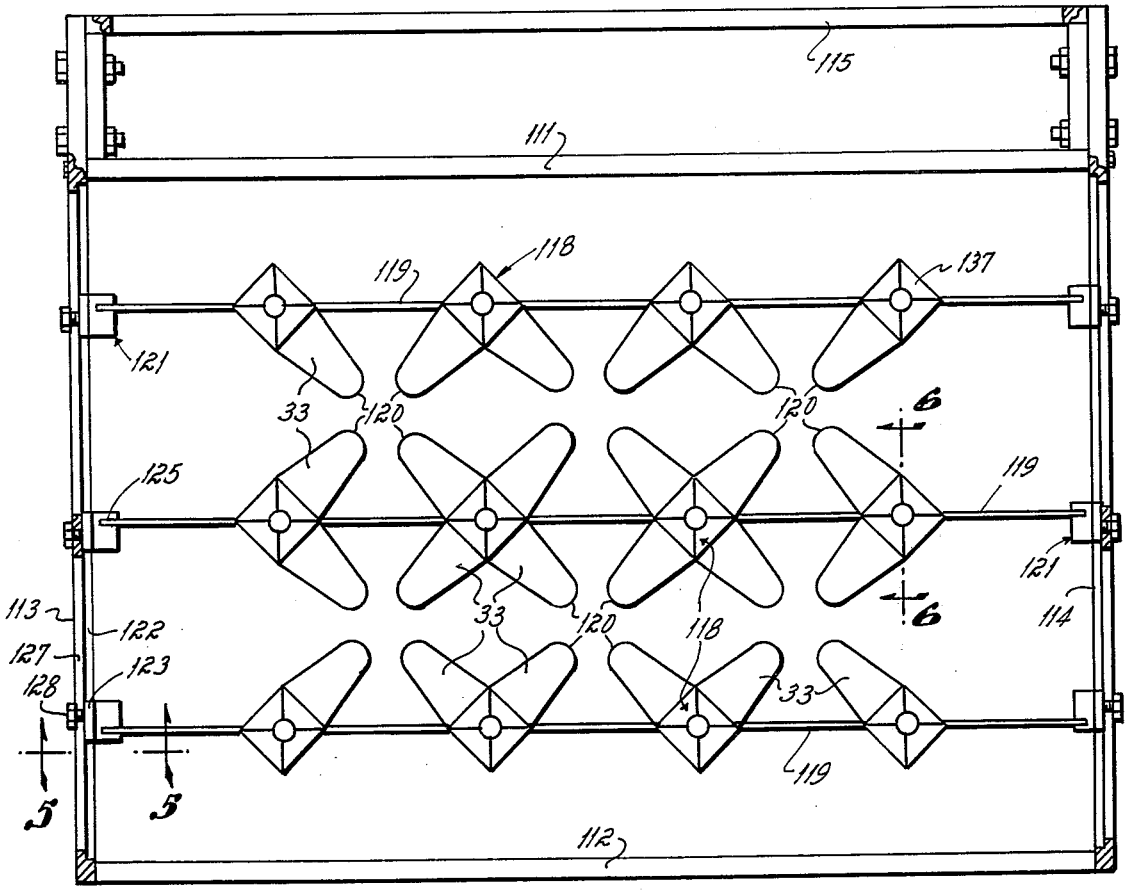
FIG. 4 is a plan view, partially in section, of the intermediate grid.

Referring to FIG. 4, it can be seen that those flap holders which are at the four corners of the array each mount only one single ended flap, which projects diagonally into a corner cell of the case. The flap holders on the periphery of the array between the four corners, each mount two single ended flaps, extending at 90° to one another and 45° to the bar from which they are mounted. The interior flap holders, within the periphery of the case, each mount a pair of double ended flaps, the flaps extending into four different cells. The flaps are desirably made of a material such as sheet Teflon for long life. Cap piece 137 is removable for replacement or for changing from a single flap to a double flap.

Each flap holder is held in desired position along bar 119, by frictional engagement between the top of the bar and a groove in body 131. The body is grooved on its base, as at 141 (indicated in dotted lines in FIG. 6). As screw 140 is tightened, it tends to draw post 129 and bar 119 upwardly with respect to the body, and to press the cap 137 and body 131 downwardly on the bar, so that the body bears frictionally on the bar.

For simplicity, the drawings show the invention components set in a 2×3 array. More commonly used arrays such as 3×4, 4×5, and 4×6 will require different lane widths and different bottle spacings. To accommodate such different arrays, additional lane dividers can be hung from rods 44 and clamped in position along the rods. Additional support bars 13 can be seated in and secured to the end members 95, 95 of the shiftable grid frame, and additional bars 119 can be inserted into the intermediate grid frame. The end plate 56 can be positioned for the desired lane length, and the lane stops can be centered within the respective lanes so that the flags which they carry project axially for engagement with the leading point on articles in the lanes. Additional (or fewer) flap holders can be positioned on the bars 119 and flaps provided thereon according to whether the posts are in the center, periphery or corners of the array.

Thus, from the foregoing it will be seen that the head, shiftable grid, and intermediate grid of this invention comprise universal change parts by which a given case packer can be adapted to handle a wide range of article sizes and arrays. This eliminates the previous necessity of maintaining an inventory of individually sized change parts for each article, size and case array required to be handled.

Having described the invention, what is claimed is:

1. A head for an automatic case packer, comprising, a head frame and means for mounting it to the packer, a series of lane dividers mounted from the frame, the dividers providing a plurality of parallel lanes between them for receiving articles in single file relation, an end plate mounted from the frame and extending transversely across the lanes, the end plate presenting a barrier which limits the length of each lane, said end plate carrying a plurality of movable flags projecting into the respective lanes, each flag being positioned for engagement by an article in its lane when the article is proximate to the end plate, at least some of the said flags being mounted from the end plate by means for shifting them in a direction transverse to their respective lanes, in order to be aligned with the respective central planes of a particular size of article to be received in the lanes, each lane divider having a vertical base wall with legs upstanding from the base wall, the divider being suspended from the frame by the legs, said end plate extending transversely across the lanes above the base walls of the respective lane dividers, said end plate having lane stops mounted to it which project downwardly into the respective lanes between the base walls of the lane dividers.

2. The head of claim 1 further wherein said lane stops are shiftable with respect to the end plate, in the direction transverse to the lanes, and means for securing the respective lane stops to the end plate in different desired positions, to correspond with different lane spacings.

3. The head of claim 1 wherein said flags are swingably mounted to said lane stops, the flags being shifted transversely with respect to the lanes as their respective lane stops are shifted.

4. The head of claim 1, further wherein said end plate is mounted to the frame for movement in the direction longitudinally of said lanes, a hand screw being connected between the frame and end plate for moving the end plate relative to the frame to a desired longitudinal position in said lanes, thereby to set the effective length of the lanes.

5. The head of claim 1, wherein the said flags are carried by the respective stops and are pivotally mounted thereon, at least some of the respective stops being carried by the end plate for shifting movement with respect to the end plate.

6. An intermediate grid for a case packer, comprising, a frame having side and end members, a plurality of parallel bars between the end members, means connecting said bars to the end members, the said means being adjustably positionable for shifting the positions at which the bars are connected to the end members thereby to change the spacing between the bars, each bar carrying a plurality of holders each mounting a guide flap, the holders being slidable along the bars for longitudinally positioning the guide flaps thereon, each said holder comprising, a post slidably engaging the bar, the post projecting vertically with respect to the bar, a body mounted to the post, means positioning the guide flap on the body so that the flap projects from the body diagonally to the bar, means for clamping the flap to the body, means for securing the body to the post, and means for clamping the post to the bar.

7. The grid of claim 6 wherein the said post presents a diametral slot, said bar extending through said slot, and said means for clamping the post to the bar comprise a surface on said body which bears frictionally on the bar when the body is secured to the post.

8. The grid of claim 6 wherein the means positioning the guide flap on the body comprise a cross groove in the body in which a portion of the flap is seated.

9. The grid of claim 6 further wherein each said end member has a groove extending along its length, the means connecting said bars to the said end members each have a boss engaged in the groove of the corresponding end member, the grid further including means securing an end portion of each bar to the respective connecting means, and means for locking the connecting means in desired position along the end member to provide a desired spacing between adjacent bars.

10. The grid of claim 6 wherein the bars are removably connected to the end members by the connecting means so that bars may be removed and so that additional holders can be slid onto said bars.

* * * * *